US010436200B2

(12) United States Patent
Blankemeier et al.

(10) Patent No.: US 10,436,200 B2
(45) Date of Patent: Oct. 8, 2019

(54) SEALED ROTOR ASSEMBLY FOR A ROTARY FLUID DEVICE

(71) Applicant: PEOPLEFLO MANUFACTURING, INC., Franklin Park, IL (US)

(72) Inventors: William R. Blankemeier, Oak Park, IL (US); Clark J. Shafer, Bolingbrook, IL (US); Michael P. Thompson, Chicago, IL (US)

(73) Assignee: PeopleFlo Manufacturing, Inc., Franklin Park, IL (US)

( * ) Notice: Subject to any disclaimer, the term of this patent is extended or adjusted under 35 U.S.C. 154(b) by 317 days.

(21) Appl. No.: 15/432,745

(22) Filed: Feb. 14, 2017

(65) Prior Publication Data

US 2018/0231015 A1 Aug. 16, 2018

(51) Int. Cl.

| | |
|---|---|
| ***F04D 29/20*** | (2006.01) |
| ***F04C 27/00*** | (2006.01) |
| ***F04C 2/08*** | (2006.01) |
| ***F04C 2/10*** | (2006.01) |
| ***F04C 15/00*** | (2006.01) |

(52) U.S. Cl.

CPC ..... *F04C 27/004* (2013.01); *F04C 2/084* (2013.01); *F04C 2/102* (2013.01); *F04C 15/0034* (2013.01); *F04C 15/0069* (2013.01); *F04D 29/20* (2013.01); *F04C 2240/70* (2013.01)

(58) Field of Classification Search

CPC ..... F05D 2250/311; F05D 2250/35; F04D 29/20; F04D 29/263; F04D 29/266

See application file for complete search history.

(56) References Cited

U.S. PATENT DOCUMENTS

| | | | | |
|---|---|---|---|---|
| 2,149,435 A * | 3/1939 | Habach | ..... | F04D 29/20 403/267 |
| 2,967,486 A * | 1/1961 | Paulsen | ..... | F04D 29/20 415/216.1 |
| 3,088,416 A | 5/1963 | Danis | | |
| 3,331,258 A | 7/1967 | Eckerle et al. | | |
| 3,395,644 A | 8/1968 | Grebel et al. | | |
| 3,998,112 A | 12/1976 | Pierrat | | |
| 4,117,746 A | 10/1978 | Pierrat | | |
| 4,135,863 A | 1/1979 | Davis et al. | | |

(Continued)

FOREIGN PATENT DOCUMENTS

| | | | | |
|---|---|---|---|---|
| GB | 174350 A * | 8/1922 | ..... | F04D 29/026 |
| GB | 578533 A * | 7/1946 | ..... | F04D 29/20 |

(Continued)

OTHER PUBLICATIONS

Janecek, Edward. Machinery's Handbook Made Easy. Industrial Press. p. 181. (Year: 2012).*

(Continued)

*Primary Examiner* — Hung Q Nguyen
*Assistant Examiner* — Mark L. Greene
(74) *Attorney, Agent, or Firm* — Cook Alex Ltd.

(57) ABSTRACT

A rotor assembly for a rotary fluid device that includes a first body at least partially exposed to a process fluid, a second body at least partially exposed to the process fluid, a connecting apparatus that includes at least one connector and at least one seal that connects the first body to the second body and seals the at least one connector from exposure to the process fluid.

19 Claims, 4 Drawing Sheets

(56) References Cited

U.S. PATENT DOCUMENTS

| | | | | |
|---|---|---|---|---|
| 4,271,726 | A | 6/1981 | Ryffel | |
| 4,316,707 | A | 2/1982 | Hansen et al. | |
| 4,578,608 | A | 3/1986 | Mech et al. | |
| 4,590,959 | A * | 5/1986 | Fort | F16K 27/07 137/315.35 |
| 4,602,727 | A | 7/1986 | Jackson | |
| 4,722,661 | A | 2/1988 | Mizuno | |
| 4,976,594 | A | 12/1990 | Bernstrom | |
| 5,211,551 | A | 5/1993 | Uppal et al. | |
| 5,269,664 | A | 12/1993 | Buse | |
| 5,313,125 | A | 5/1994 | Bosman et al. | |
| 5,365,137 | A | 11/1994 | Richardson et al. | |
| 5,735,668 | A | 4/1998 | Klein | |
| 5,755,817 | A | 5/1998 | Prouty et al. | |
| 5,895,203 | A | 4/1999 | Klein | |
| 5,939,807 | A | 8/1999 | Patyk et al. | |
| 6,315,080 | B1 | 11/2001 | Doran | |
| 6,578,674 | B2 | 6/2003 | Doran | |
| 6,681,898 | B1 | 1/2004 | Doran | |
| 7,137,793 | B2 | 11/2006 | Shafer et al. | |
| 7,781,926 | B2 | 8/2010 | Schmidt et al. | |
| 9,057,273 | B2 * | 6/2015 | Wang | B64C 39/024 |
| 2004/0130228 | A1 | 7/2004 | Chang | |
| 2006/0008368 | A1 | 1/2006 | Czechowski et al. | |
| 2006/0177321 | A1 | 8/2006 | Edwards et al. | |
| 2006/0192453 | A1 | 8/2006 | Gieras et al. | |
| 2008/0197740 | A1 | 8/2008 | Hughes | |
| 2010/0180720 | A1 | 7/2010 | Kempf et al. | |
| 2015/0129711 | A1 * | 5/2015 | Caubel | B64C 27/08 244/17.23 |
| 2015/0354694 | A1 | 12/2015 | Degenhart et al. | |

FOREIGN PATENT DOCUMENTS

| | | | |
|---|---|---|---|
| GB | 2240590 | A | 8/1991 |
| IT | 1227116 | B | 3/1991 |

OTHER PUBLICATIONS

Pump School. "Internal Gear Pumps." http://www.pumpschool.com/principles/internal.asp. Captured Sep. 5, 2015. (Year: 2015).*

T-Mag Pumps. "What is a Mag Drive Pump?" http://www.tmagpumps.com/what-is-a-mag-drive-pump. Captured Dec. 18, 2015. (Year : 2015).*

International Search Report and Written Opinion for PCT/US2018/017194 dated Apr. 19, 2018.

* cited by examiner

SEALED ROTOR ASSEMBLY FOR A ROTARY FLUID DEVICE

BACKGROUND OF THE INVENTION

The present invention generally relates to rotor assemblies for rotary fluid devices such as pumps, flowmeters, turbines, and mixers for use in hygienic and sanitary applications, and more particularly to rotor assemblies having two or more parts that are connected in a sealed configuration.

It is known to one skilled in the prior art that a rotor assembly may include two or more parts in order to reduce production and maintenance costs, enable the utilization of materials with optimal physical properties, and improve interchangeability. Such arrangements often are located within a region of the rotary device that places the rotor assembly in contact with a process fluid. This is disadvantageous if the rotary fluid device is intended for use in hygienic and sanitary applications, because such a rotor assembly should be free from pockets, gaps, and crevices that are in contact with process fluid, which may promote microbial growth or collection of soil, leading to contamination of the fluid.

Multiple-part rotor assemblies for rotary fluid devices in the prior art generally include a number of elements which can prevent usage in sanitary and hygienic applications, such as, traditional fasteners, for instance socket head screws, exposed threads, interference fits used to assemble parts with non-circular cross sections, shoulders, or relieved areas, and unsealed adjacent surfaces through which process fluid does not normally flow.

As such, prior art rotary fluid devices that are designed for use in hygienic and sanitary applications typically have been designed without multiple-part rotor assemblies or with multiple-part rotor assemblies joined by polished welds, so as to comply with industry regulations regarding cleanliness, thus sacrificing the potential benefits that otherwise may be available in multiple-part rotor assemblies.

The present disclosure seeks to overcome the shortcomings of the prior art to realize a rotor assembly that is useful and suitable for hygienic and sanitary applications.

SUMMARY OF THE INVENTION

The disadvantages of the prior art are overcome by example rotary fluid device rotor assemblies of the present disclosure. In a first aspect, the disclosure provides a rotor assembly for a rotary fluid device that includes a first body at least partially exposed to a process fluid, a second body at least partially exposed to the process fluid, a connecting apparatus that includes at least one connector and at least one seal that connects the first body to the second body and seals the at least one connector from exposure to the process fluid.

In some embodiments, the at least one connector further comprises at least one protruding member extending from the first body and being received in a cavity of the second body, which may include an inwardly-extending shoulder which acts to, at least partially, restrain separation of the first body and the second body. In such embodiments, the shoulder may be integral to the second body or removably connected to the second body. Further, the protruding members may be integral to the first body or they may be separable bodies which are received in a cavity of the first body.

Generally, the first body is removably connected to the second body via the connecting apparatus when the second body is rotated in a first direction relative to the first body and about a common axis of rotation to a selected angular locking position, wherein the connecting apparatus will axially attach the rotor head and the rotor body and allow the communication of torque.

The seal of the connecting apparatus is a static sealing element such as an O-ring, gasket, or liquid sealant. If the static sealing element requires compression, the compression is applied during the assembly of the connecting apparatus. The shoulder of the second body may vary in thickness to gradually compress the static sealing element as the second body is rotated relative to the first body.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred example embodiments, reference is made to the accompanying drawing figures wherein like parts have like reference numerals, and wherein.

Figure 1:
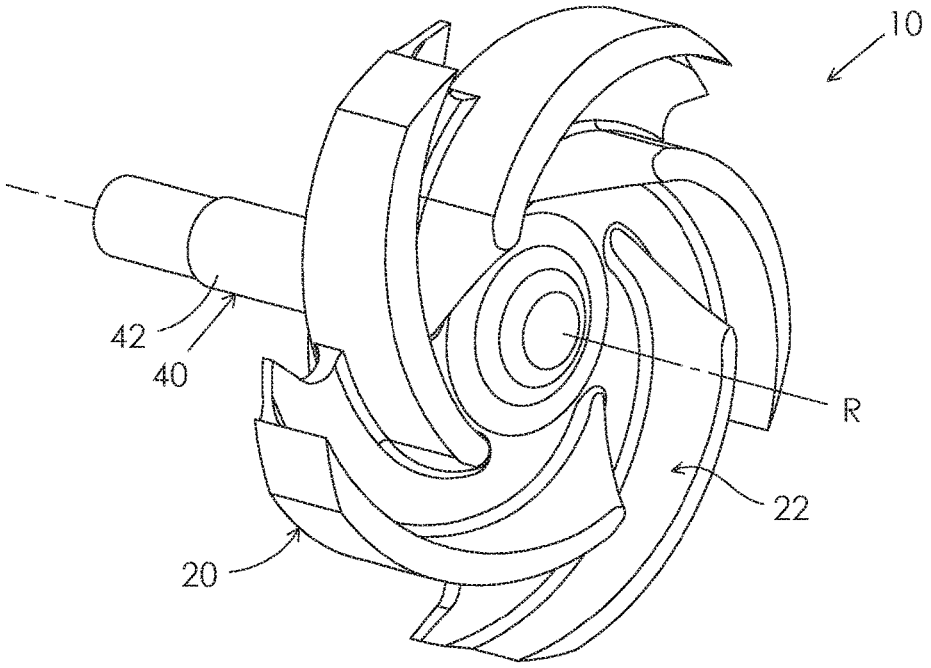
FIG. 1 shows a perspective front view of a first example rotor assembly.
Figure 2:
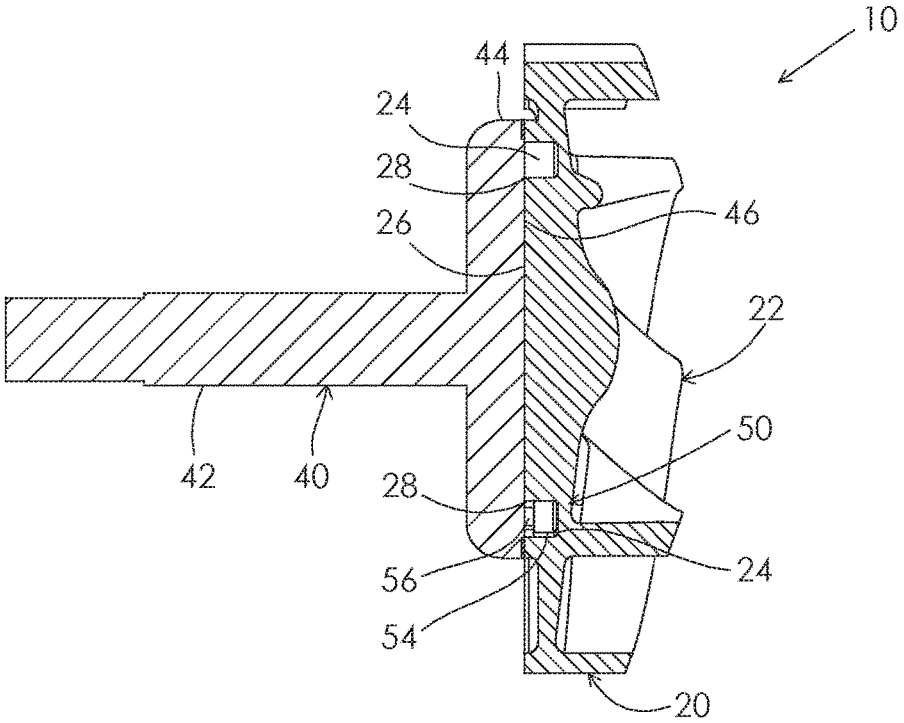
FIG. 2 shows a sectioned side view of the first example rotor assembly of FIG. 1.
Figure 3:
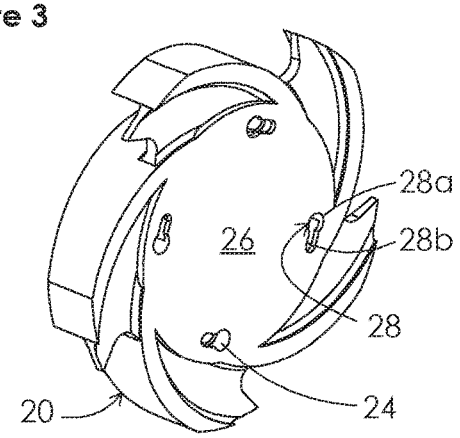
FIG. 3 shows a perspective rear view of the rotor head of the first example rotor assembly of FIG. 1.
Figure 4:
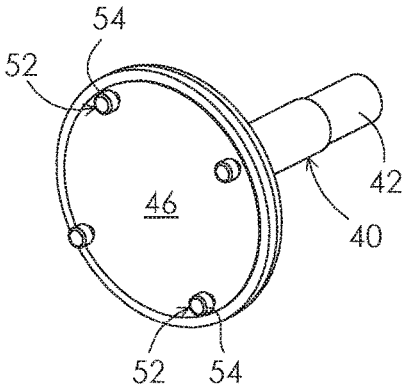
FIG. 4 shows a perspective front view of the rotor body of the first example rotor assembly of FIG. 1.

It should be understood that the drawings are not to scale. While some mechanical details of the example rotor assemblies, including details of fastening means and other plan and section views of the particular components, may not have been shown, such details are considered to be within the comprehension of those skilled in the art in light of the present disclosure. It should be understood that the present disclosure and claims are not limited to the preferred embodiments illustrated.

DETAILED DESCRIPTION OF PREFERRED EMBODIMENTS

Referring broadly to FIGS. 1-11, it will be appreciated that rotor assemblies of the present disclosure generally may be embodied within numerous configurations. Also, the teachings within this disclosure may pertain to rotor assemblies for use in a variety of rotary fluid devices.

FIGS. 1-7 illustrate the present invention in a first example embodiment as a centrifugal pump rotor assembly 10 comprising a first body 20, herein referred to as a rotor head, and a second body 40, herein referred to as a rotor body, and a connecting apparatus 50, including a plurality of connectors, for sealingly connecting the rotor head 20 to the rotor body 40.

The rotor body 40 includes an integral shaft member 42, to which input torque may be applied, and a generally cylindrical forward portion 44 having a forward facing surface 46. The connecting apparatus 50 includes a plurality of integral protruding members 52, which act as connectors, positioned circumferentially about a rotor assembly axis of rotation R and which extend forward axially. It should be understood that the term "forward" is used arbitrarily herein with respect to location within a rotary fluid device, and to refer to the direction of the position of the rotor head 20 relative to the rotor body 40 in a given figure. Each protruding member 52 has a head 54 and a neck 56, wherein the neck 56 is defined by a length of the protruding member 52 between the head 54 and the forward facing surface 46. The neck 56 has a first diameter, and the head 54 has a second diameter, with the first diameter of the neck 56 being smaller than the second diameter of the head 54.

The rotor head 20 includes hydraulically requisite geometric features 22 of an open centrifugal pump impeller. The rotor head 20 further comprises a plurality of cavities 24 positioned circumferentially about the axis of rotation R and so as to align with the protruding members 52 of the rotor body 40. The plurality of the cavities 24 are open to a rearward facing surface 26 of the rotor head 20 via a plurality of apertures 28 for the cavities 24.

The shape of the apertures 28 is such that, at a first angular position of the rotor head 20 relative to the rotor body 40, herein referred to as the insertion position 28*a*, the heads 54 of the plurality of protruding members 52 of the rotor body 40 may be simultaneously passed through the apertures 28 and be received within the rotor head cavities 24. Further, the shape of the apertures 28 is such that, at a second angular position of the rotor head 20 relative to the rotor body 40, herein referred to as the locking position 28*b*, each aperture 28 simultaneously has a narrowed portion that is narrower than the head 54 of a protruding member 52 but wider than the neck 56 of the protruding member 52, thereby forming an inward facing partial shoulder 30 for each cavity 24. At the locking position 28*b*, the rearward face 58 of the head 54 of the protruding members 52 is engaged by the forward face 32 of the shoulders 30 of the apertures 28, thus the rotor head 20 and rotor body 40 are prevented from being axially separated. Further, at the locking position 28*b*, a head 54 or neck 56 of a protruding member 52 is additionally restrained by the shape and length of the cavity 24 or aperture 28 from rotating relative to the rotor head 20 in the direction of the rotation from the insertion position 28*a* to the locking position 28*b*. Thus, input torque may be transmitted between the rotor body 40 and the rotor head 20 provided that an intended direction of rotation of the rotor assembly 10 is opposite the direction of rotation of the rotor head 20 from the insertion position 28*a* to the locking position 28*b*.

Figure 5:
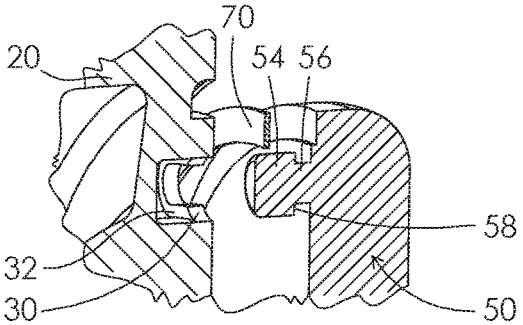
FIG. 5 shows a sectioned partial exploded perspective view of the connecting apparatus of the first example rotor assembly of FIG. 1.
Figure 6:
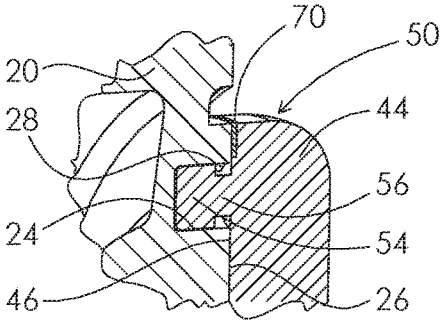
FIG. 6 shows a sectioned partial perspective view of the connecting apparatus of the first example rotor assembly of FIG. 1, in a first rotational position.
Figure 7:
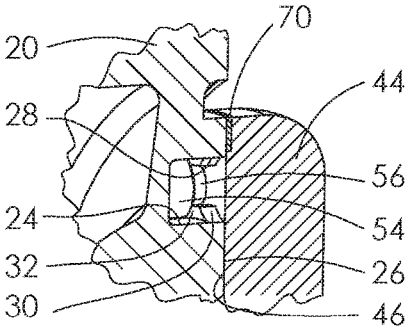
FIG. 7 shows a sectioned partial perspective view of the connecting apparatus of the first example rotor assembly of FIG. 1, in a second rotational position.
Figure 8:
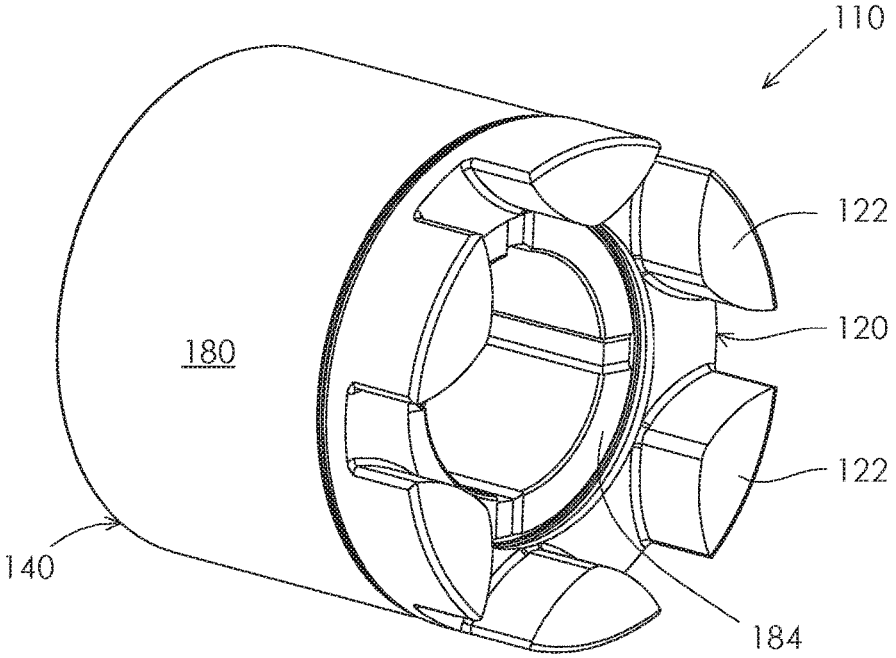
FIG. 8 shows a perspective front view of a second example rotor assembly.

FIGS. 5-7 depict the sequential assembly process, through which the rotor assembly 10 is defined. In FIG. 5, a rotor head 20 and a rotor body 40 are relatively aligned to the insertion position 28*a* whereby a protruding member 52 of a rotor body 40 is inserted through an aperture 28 at a wider portion, and is received into a cavity 24 of the rotor head 20, as shown in FIG. 6. Subsequently, the rotor head 20 is rotated relative to the rotor body 40 to the locking position 28*b*, as shown in FIG. 7, from which the heads 54 of the protruding members 52 are axially and rotationally restrained at the narrower portions of the apertures 28.

The connecting apparatus 50 comprises features required for sealingly attaching the first and second bodies 20, 40, including the protruding members 52 of the rotor body 40, and the cavities 24 and apertures 28 of the rotor head 20. In this example, the connecting apparatus 50 also includes a static sealing element 70, shown in the first preferred embodiment as a gasket, which prevents ingress of the process fluid or other external contaminants into the rotor assembly 10 and, therefore, prevents contact with the connectors. This sealing element 70 may alternatively include an O-ring, liquid sealant, or other well-known sealing apparatus. If the static sealing element 70 requires compression, the connecting apparatus 50 may be designed so that the appropriated compression is achieved at the insertion position 28*a* and fixedly maintained at the locking position 28*b*, such as is illustrated with the gasket in the first preferred embodiment in FIGS. 5-7.

The first example embodiment illustrates the present invention as a rotor assembly 10 that does not employ traditional fasteners, such as socket head screws, exposed threads, interference fits used to assemble parts with non-circular cross sections, shoulders, or relieved areas, and unsealed adjacent surfaces through which process fluid does not normally flow. Thus, the rotor assembly 10 is free from externally exposed stagnant or dead areas, gaps, and crevices that would be in contact with the process fluid and may promote microbial growth or collection of soil, leading to contamination of the fluid.

It should be appreciated that the first example embodiment could instead be configured with the protruding members 52 in the rotor head 20 and the cavities 24 and apertures 28 in the rotor body 40. It also should be appreciated that the process of removably connecting the rotor head 20 and the rotor body 40 is repeatable without damage to or destruction of the rotor body 40, rotor head 20, or connecting apparatus 50, although it may be necessary to replace the at least one sealing element 70 after disassembly.

Turning to FIGS. 8-11, a second example embodiment is shown in the form of a magnetically driven internal gear pump rotor assembly 110 comprising a first body, referred to as a rotor body 140, a second body, referred to as a rotor head 120, and a connecting apparatus 150, including a plurality of connectors, for sealingly connecting the rotor head 120 to the rotor body 140.

Figure 9:
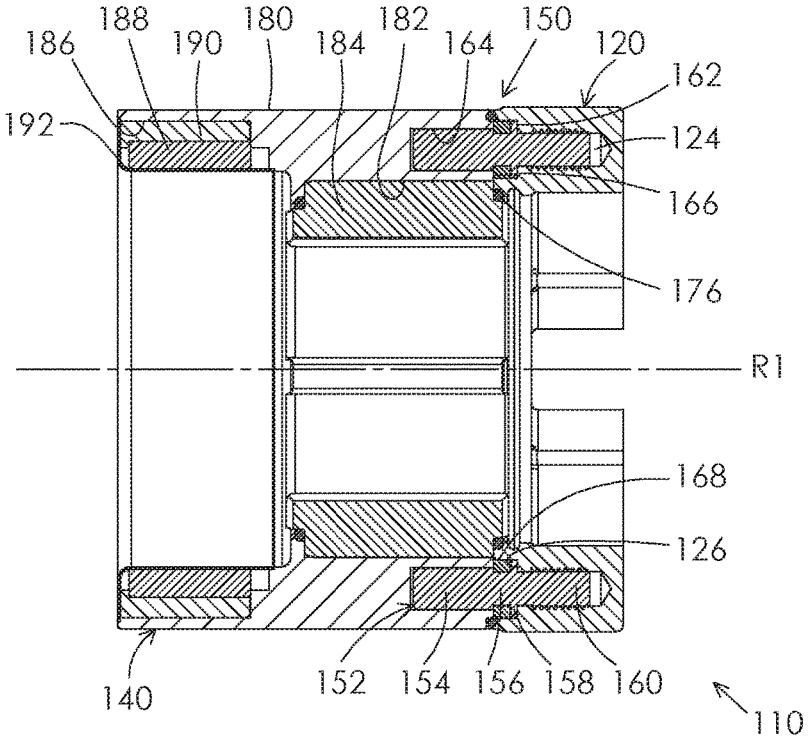
FIG. 9 shows a sectioned side view of the second example rotor assembly of FIG. 8.
Figure 10:
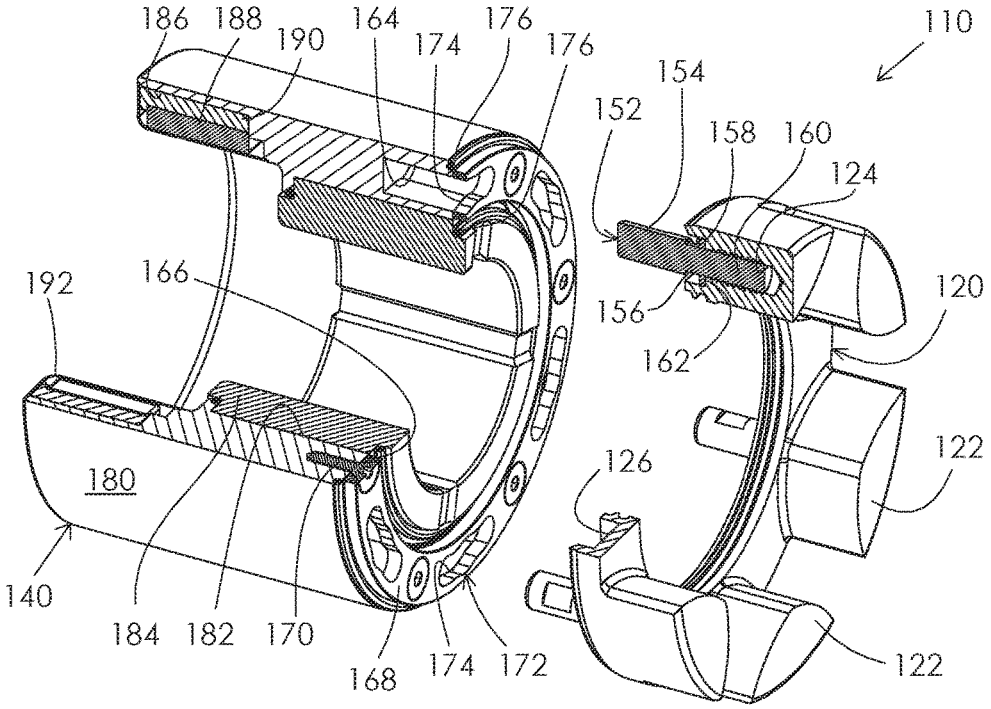
FIG. 10 shows a perspective partially exploded front view of the second example rotor assembly of FIG. 8.
Figure 11:
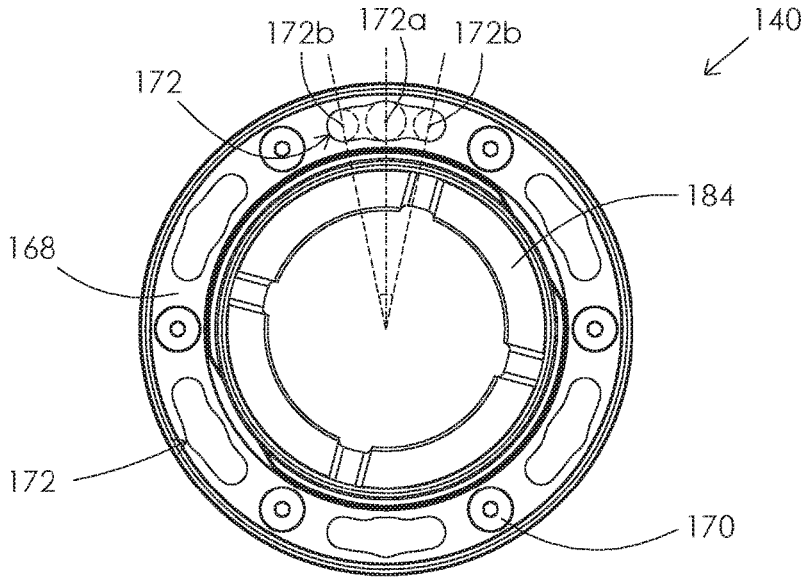
FIG. 11 shows a front end view of a rotor body of the second example rotor assembly of FIG. 8.

The rotor head 120 is generally cylindrical and has a plurality of gear teeth 122 protruding radially inward and forward axially. The rotor head 120 further comprises a plurality of threaded cavities 124 positioned circumferentially about the axis of rotation R1 of the rotor assembly 110 and open to a rearward facing surface 126 of the rotor head 120. As shown in FIGS. 9-11, the cavities 124 extend at least partially into the plurality of gear teeth 122, but it should be appreciated that the invention is only limited by the claimed subject matter. The rotor head 120 further comprises a plurality of locking pins 152. Each locking pin 152 is in the form of a threaded stud and has a head 154, a neck 156, a flange 158, and a threaded portion 160. The threaded portion 160 of each locking pin 152 is in threaded engagement with a threaded cavity 124 to a maximum depth defined by engagement of a forward facing surface 162 of the flange 158 and the rearward facing surface 126 of the rotor head 120. The neck 156 is defined by a length of the locking pin 152 between the head 154 and the flange 158. The neck 156 has a first diameter, and the head 154 has a second diameter, with the first diameter of the neck 156 being smaller than the second diameter of the head 154.

The rotor body 140 has a substantially cylindrical outer surface 180 and a first central aperture 182 into which a bushing 184 or other friction reducing means is connected to support the assembly of the rotor body 140 as it rests slidably and rotatably about an inner journal, which is not shown. The rotor body 140 has a second central aperture 186, having a larger diameter than that of the first central aperture 182, and containing a plurality of magnet segments 188. The magnet segments 188 are positioned circumferentially and so as to have alternating polarity. The plurality of magnet segments 188 may be attached directly to the rotor body 140 or may be attached to an intermediate annular ring 190, which is connected to the rotor body 140, such as is shown in the second example embodiment depicted in FIGS. 9 and 10. The plurality of magnet segments 188 generally are sealed by a thin annular sleeve 192, which is fixedly and sealingly connected to the rotor body 140, so as to prevent exposure to the process fluid and avoid contamination.

The rotor body 140 further comprises a plurality of cavities 164 that are open at a forward facing surface 166 of the rotor body 140 and positioned circumferentially about the axis of rotation R1 and so as to correspond with the positions of the locking pins 152 of the rotor head 120. The plurality of cavities 164 are aligned with the plurality of the heads 154 of the locking pins 152, so as to receive the heads 154 of the locking pins 152 and restrain radial displacement of the locking pins 152. Each of the plurality of cavities 164 has a depth which is at least the length of the head 154 of a locking pin 152. The cavities 164 are partially covered by an annular locking ring 168, which is connected to the rotor body 140 at the forward facing surface 166. In this example, the annular locking ring 168 is connected to the rotor body 140 by a plurality of fasteners 170 such as screws or by other well-known fastening means.

The locking ring 168 includes a plurality of apertures 172 generally corresponding to the quantity and position of the cavities 164. However, the shape of the apertures 172 in the locking ring 168 is such that, at a first angular position of the rotor head 120 relative to the rotor body 140, herein referred to as the insertion position 172*a*, the apertures 172 have a wider portion at which the heads 154 of the plurality of locking pins 152 of the rotor head 120 may simultaneously be passed through the locking ring 168 and be received within the cavities 164 of the rotor body 140. Further, as best seen in FIGS. 10 and 11, the shape of the apertures 172 in the locking ring 168 is such that, at a second angular position of the rotor head 120 relative to the rotor body 140, herein referred to as the locking position 172*b*, each aperture 172 has a narrowed portion that is narrower than a head 154 of a locking pin 152 while being wider than the neck 156 of the locking pin 152, thereby forming a partial shoulder 174 for each cavity 164, by which the head 154 or neck 156 of the locking pin 152 is restrained from being displaced axially forward. In the locking position 172*b*, the head 154 of a locking pin 152 also is restrained by the shape of the cavity 164 or locking ring 168 from rotating further relative to the rotor body 140 in the direction of the rotation from the insertion position 172*a* to the locking position 172*b*. This enables input torque to be communicated between the rotor body 140 and the rotor head 120 provided that an intended direction of rotation of the rotor assembly 110 is opposite the direction of rotation of the rotor head 120 from the insertion position 172*a* to the locking position 172*b*.

The second example rotor assembly 110, as shown in FIGS. 8-11, includes a second locking position 172*b* by virtue of the apertures 172 in the locking ring 168 having a second narrowed portion, which is in the opposite direction of rotation from the first locking position 172*b*. As shown, the narrowed portions for the locking positions 172*b* are on opposite sides of the wider portion at the insertion position 172*a*. Thus, the gear pump rotor can be assembled and used in a clockwise or counter-clockwise rotational direction.

The connecting apparatus 150 includes features required for sealingly attaching the first and second bodies 120, 140, such as the locking pins 152, cavities 124 and 164, and locking ring 168. The connecting apparatus further comprises two O-rings 176 used as the static sealing elements to prevent ingress of the process fluid or other external contaminants into the rotor assembly 110. In the second example embodiment, the shoulder 174 created by the locking ring 168 includes a tapered thickness that acts to gradually move the locking pin head 154 in a rearward axial direction as the head 154 is rotating from the insertion position 172*a* to a locking position 172*b*. This is accomplished, for instance, by making the locking ring 168 thicker in the area of the narrower portions of the apertures 172 than near the wider portions of the apertures 172. This causes the O-rings 176 to be compressed via rotational motion, which will limit the amount of axial force required to assemble the rotor head 120 to the rotor body 140.

It should be appreciated that the geometry created by the locking ring 168 alternatively may be integral to the forward surface 166 of the rotor body 140, such as was illustrated on the rotor head 120 in the first example embodiment, which may permit similar locking capability without the need for the plurality of fasteners 170.

From the above disclosure, it will be apparent that sealed rotor assemblies constructed in accordance with this disclosure may include a number of structural aspects that provide advantages over conventional constructions, depending upon the specific design chosen.

It will be appreciated that sealed rotor assemblies may be embodied in various configurations with respect to the type of rotor to be employed. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such sealed rotor assemblies without departing from the scope or spirit of the claimed subject matter, and that the claims are not limited to the preferred embodiment illustrated herein.

The invention claimed is:

1. A rotor assembly for a rotary fluid device, the rotor assembly comprising:

a first body at least partially exposed to a process fluid;

a second body at least partially exposed to the process fluid;

wherein the first body and the second body have a common axis of rotation;

a connecting apparatus that connects the first body to the second body, and wherein the connecting apparatus comprises a plurality of connectors positioned circumferentially about the axis of rotation and protruding from the second body in a direction parallel to the axis of rotation, with the first body further comprising a corresponding plurality of cavities that are aligned with and receive the respective plurality of connectors protruding from the second body, and at least one seal disposed between the first body and the second body which seals the plurality of connectors and the plurality of cavities from exposure to the process fluid.

2. The rotor assembly of claim 1 wherein each of the first body and the second body further comprises an open axially extending central aperture located about the axis of rotation.

3. The rotor assembly of claim 2 wherein a bushing is fixedly disposed within the open axially extending central aperture of the first body.

4. The rotor assembly of claim 1 wherein each of the plurality of connectors protruding from the second body is a separable body that is received within a respective one of a plurality of cavities in the second body.

5. The rotor assembly of claim 4 wherein each of the plurality of cavities in the second body further comprises threads that receive one of the respective plurality of connectors.

6. The rotor assembly of claim 1 wherein each of the plurality of connectors protruding from the second body is integrally formed with the second body.

7. The rotor assembly of claim 1 wherein the first body further comprises a plurality of shoulders, with each shoulder corresponding to a respective one of the plurality of cavities and restraining a respective one of the plurality of connectors protruding from the second body.

8. The rotor assembly of claim 7 wherein each of the plurality of shoulders is inwardly-extending and adjacent a respective one of the plurality of cavities in the first body.

9. The rotor assembly of claim 7 wherein each of the plurality of shoulders is removably connected to the first body.

10. The rotor assembly of claim 7 wherein each of the plurality of shoulders each shoulder varies in thickness circumferentially.

11. The rotor assembly of claim 1 wherein the at least one seal further comprises an O-ring, a gasket or liquid sealant.

12. The rotor assembly of claim 1 wherein the first body is removably connected to the second body.

13. The rotor assembly of claim 12 wherein the first body and the second body may be disassembled and reassembled repeatedly.

14. The rotor assembly of claim 1 wherein the first body or the second body is configured to be magnetically driven.

15. The rotor assembly of claim 1 wherein the second body further comprises a plurality of gear teeth.

16. The rotor assembly of claim 15 wherein each of the plurality of gear teeth further comprises a cavity, and each of the plurality of connectors is received in the cavity of one of the respective plurality of gear teeth.

17. The rotor assembly of claim 1 wherein the first body or the second body further comprises an impeller.

18. The rotor assembly of claim 1 wherein the connecting apparatus transmits net torque between the first body and the second body in at least one rotational direction.

19. The rotor assembly of claim 1 wherein the second body is connected to the first body when the second body is rotated in a first direction relative to the first body and about the axis of rotation to a selected angular locking position.

* * * * *